US008690008B2

(12) United States Patent
Conway et al.

(10) Patent No.: US 8,690,008 B2
(45) Date of Patent: Apr. 8, 2014

(54) SPONGE SHEET DISPENSER

(75) Inventors: Simon M. Conway, Burlington, WI (US); Michael M. Sawalski, Racine, WI (US); Benjamin J. Paprocki, Madison, WI (US); Scott Padiak, Glencoe, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 128 days.

(21) Appl. No.: 12/792,645

(22) Filed: Jun. 2, 2010

(65) Prior Publication Data

US 2011/0297692 A1 Dec. 8, 2011

(51) Int. Cl.
*A47K 10/42* (2006.01)

(52) U.S. Cl.
USPC ..... 221/46; 221/45; 221/49

(58) Field of Classification Search
USPC ..... 221/33, 45, 46, 47, 48, 49; D6/518
See application file for complete search history.

(56) References Cited

U.S. PATENT DOCUMENTS

| | | | | | |
|---|---|---|---|---|---|
| 1,852,114 | A | | 4/1932 | Green | |
| 2,237,424 | A | * | 4/1941 | Hope | 221/48 |
| 2,573,309 | A | * | 10/1951 | Chipkevich | 221/63 |
| 2,840,268 | A | * | 6/1958 | Casey et al. | 221/49 |
| 2,911,175 | A | * | 11/1959 | Erie | 248/217.2 |
| 3,168,275 | A | | 2/1965 | Grondin | |
| 3,634,183 | A | | 1/1972 | Viola et al. | |
| 3,970,215 | A | * | 7/1976 | McLaren et al. | 221/45 |
| 4,002,264 | A | * | 1/1977 | Marchesani | 221/63 |
| 5,417,345 | A | | 5/1995 | Smith | |
| 5,462,197 | A | * | 10/1995 | Pound | 221/46 |
| 5,509,571 | A | * | 4/1996 | Weber | 221/46 |
| 5,531,325 | A | * | 7/1996 | Deflander et al. | 206/494 |
| 5,613,608 | A | | 3/1997 | Tronchetti et al. | |
| D389,682 | S | * | 1/1998 | Gene | D6/518 |
| 5,894,954 | A | | 4/1999 | Horian | |
| 6,000,538 | A | * | 12/1999 | Lee | 206/233 |

(Continued)

FOREIGN PATENT DOCUMENTS

| | | | |
|---|---|---|---|
| CA | 2124246 | A * | 11/1995 |
| CA | 2124246 | A1 | 11/1995 |
| EP | 0879575 | A1 | 11/1998 |

OTHER PUBLICATIONS

PCT/US2011/000990 International Search Report dated Aug. 31, 2011.

English translation of CA 2124246, cited against claims in Office action but for which no translation was provided by USPTO; 4 pages, Nov. 1995.

*Primary Examiner* — Patrick Mackey

(57) ABSTRACT

A device for dispensing a sheet from a stack of sheets is disclosed. The device includes a holder for receiving a refill container including the stack of sheets. The holder includes a holder base wall and opposed holder side walls extending up from the holder base wall. The refill container includes a container base wall and opposed first and second container side walls extending up from the container base wall. A first flap extends inward from an end of the first container side wall, and a second flap extends inward from an end of the second container side wall. The first flap and the second flap are dimensioned to define a longitudinal dispensing slot of the container. At least one of the first flap and the second flap of the container can flex upward when a sheet is dispensed from the device. In one form, the sheets comprise a thin sponge material.

18 Claims, 3 Drawing Sheets

(56) References Cited

U.S. PATENT DOCUMENTS

| | | | | |
|---|---|---|---|---|
| 6,213,344 | B1 * | 4/2001 | Hill | 221/38 |
| 6,644,501 | B2 * | 11/2003 | Iida | 221/48 |
| 6,857,159 | B1 | 2/2005 | Strine | |
| 7,063,233 | B2 * | 6/2006 | Jordan et al. | 221/197 |
| 7,275,656 | B1 | 10/2007 | Samadani | |
| 7,568,594 | B2 | 8/2009 | Long | |
| 2006/0010634 | A1 | 1/2006 | Moser et al. | |
| 2008/0237254 | A1 | 10/2008 | Liu et al. | |

* cited by examiner

SPONGE SHEET DISPENSER

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

1. Field of the Invention

The invention relates to a dispenser for sheets, and more particularly to a dispenser for a stack of sponge sheets used for cleaning.

2. Description of the Related Art

Sponges are a fairly robust, substantial cleaning tool that consumers keep near the sink, to help them with messes, spills and clean ups. One universal problem with sponges has to do with odor and appearance. Current methods to take care of this include placing the sponge in a microwave, placing the sponge in the dishwasher, washing the sponge in hot soap and water, soaking the sponge in vinegar, soaking the sponge in baking soda and water, and (most often), doing nothing. In the end, the sponge always gets thrown away, much to the dissatisfaction of the consumer, as they feel it is not yet "used up", because it is so large. Sponges are also perceived as taking a long time to biodegrade in landfills because of their size.

In addition to more acceptable sponge configurations, consumers desire more efficient devices that can be used to store and dispense sheets of cleaning materials. Sheet materials are often interfolded into stacks and placed into a dispenser such that upon removal of one sheet, a subsequent sheet is partially dispensed having an exposed portion that extends from the dispenser's opening. This method of "pop-up" sheet dispensing is convenient for many applications, since the next sheet is readily presented for quick access. However, the pop-up sheet dispensing feature can become unreliable as the height of the dispenser increases and/or the stack height of the remaining sheets decreases. When this occurs, the partially dispensed sheet can "fall-back" into the dispenser's interior where it is inconvenient to reach. Thus, consumers desire dispensers that work easily with one hand without the problems associated with sheet "fall back".

Therefore, there is need for alternative sponge materials that will help consumers achieve light duty clean ups with smaller sized sponges and that are seen by consumers as better for the environment due to shorter biodegrade times. Also, there is a need for improved devices that can be used to dispense sheets of these sponge materials easily with one hand without sheet "fall back".

SUMMARY OF THE INVENTION

The foregoing needs are met by a dispenser according to the invention. The dispenser includes a decorative and easily accessible container to dispense a dry sponge sheet one sheet at a time. The dispenser works easily with one hand and can be placed either flat or standing up on a surface or it can be mounted directly on a surface at any orientation (i.e. right side up, upside down, vertical or horizontal).

In one aspect, the invention provides a device for dispensing a sheet from a stack of sheets. The device includes a holder for receiving a container including the stack of sheets. The holder includes a holder base wall having a first end and an opposite second end, a first holder side wall extending from the first end of the base wall, a second holder side wall extending from the second end of the holder base wall, a third wall extending inward from an end of the first holder side wall, and a fourth wall extending inward from an end of the second holder side wall. The holder base wall, the first holder side wall, the second holder side wall, the third wall and the fourth wall of the holder define an inner space for receiving the container. The holder base wall can include a third end joining the first end to the second end, and the holder can further include a fifth wall extending at a generally right angle from the third end of the holder base wall. The holder base wall can include at least one mounting throughhole dimensioned to allow a mounting member to pass into the mounting throughhole for mounting the holder in a position on a surface other than dispensing slot up.

The container is disposed in the inner space of the holder. The container can comprise a transparent material. The container includes a container base wall having a first end and an opposite second end, a first container side wall extending from the first end of the container base wall, a second container side wall extending from the second end of the container base wall, a first flap extending inward from an end of the first container side wall, and a second flap extending inward from an end of the second container side wall. The first flap and the second flap are dimensioned to define a longitudinal dispensing slot of the container. A stack of sheets is disposed in the container. At least one of the first flap and the second flap of the container can flex upward when a sheet is dispensed from the device. Opposed transverse edges of the first flap and the second flap are preferably not attached to any side walls of the container to allow for upward flexing of the first flap and the second flap. Preferably, the dispensing slot of the container extends from one end to an opposite end of the container.

In one form, the sheets comprise a sponge material, and the sheets are V-folded and interleaved in a flat stack such that a portion of a leading panel of a following sheet in the flat stack is placed between a leading panel and a trailing panel of a preceding sheet. In another form, the sheets comprise a cellulose sponge material. The sheets can have a thickness between 0.030" and 0.250" when dry.

In another aspect, the invention provides a refill container for installation in a holder for a device for dispensing a sheet from a stack of sheets. The refill container preferably comprises a transparent material. The refill container includes a base wall having a first end and an opposite second end, a first side wall extending from the first end of the base wall, a second side wall extending from the second end of the base wall, a first flap extending inward from an end of the first side wall, and a second flap extending inward from an end of the second side wall. The first flap and the second flap are dimensioned to define a longitudinal dispensing slot of the refill container, and at least one of the first flap and the second flap can flex upward when a sheet is dispensed from the device. The refill preferably includes a stack of sheets disposed in the refill container. Opposed transverse edges of the first flap and the second flap are preferably not attached to any side walls of the refill container to allow for upward flexing of the first flap and the second flap. Open ends of the refill container allow for easy insertion of the stack of sheets into the refill container when a user decides to reuse the refill container. Preferably, the dispensing slot of the refill container extends from one end to an opposite end of the container. This also allows for upward flexing of the first flap and the second flap.

In one form, the sheets in the refill container comprise a sponge material, and the sheets are V-folded and interleaved in a flat stack such that a portion of a leading panel of a following sheet in the flat stack is placed between a leading panel and a trailing panel of a preceding sheet. In another form, the sheets comprise a cellulose sponge material. The sheets can have a thickness between 0.030" and 0.250" when dry.

These and other features, aspects, and advantages of the present invention will become better understood upon consideration of the following detailed description, drawings, and appended claims.

BRIEF DESCRIPTION OF THE DRAWINGS

Like reference numerals will be used to refer to like parts from Figure to Figure in the following detailed description.

DETAILED DESCRIPTION OF THE INVENTION

Figure 1:
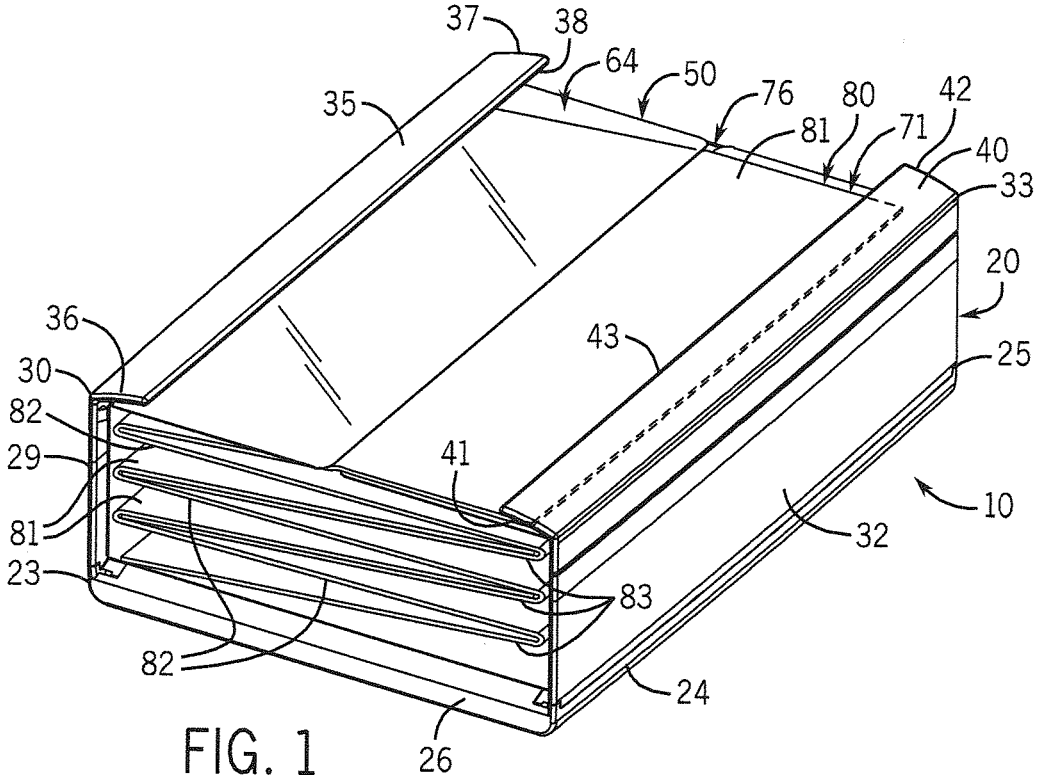
FIG. 1 is a top, left, front perspective view of a dispenser in accordance with the invention.

Looking at FIGS. 1 to 8, there is shown a dispenser 10 according to one example embodiment of the invention. In one non-limiting example, the dispenser 10 is a cuboid about 7" long by about 5" wide by about 2" high. The dispenser 10 includes a holder 20 having a bottom base wall 22 with a first end 23, a second end 24, a third end 25, and a fourth end 26. The base wall 22 has a generally rectangular shape in the embodiment shown. The holder 20 has a first side wall 29 having a top end 30, and has a second side wall 32 having a top end 33. The first side wall 29 and the second side wall 32 have a generally rectangular shape in the embodiment shown. The first side wall 29 extends upward from the first end 23 of the base wall 22, and the second side wall 32 extends upward from the second end 24 of the base wall 22.

The use of relative terms such as "top", "bottom", "inward", "upward" and "downward" and the like when describing the dispenser 10 of the invention is not intended to limit the orientation in which the dispenser 10 may be used. Such relative terms merely serve to more conveniently describe the invention. Unless the context clearly indicates the contrary, "inward" will refer to the direction toward a region of the dispenser 10 inward from the perimeter of the dispenser 10, "downward" will refer to the direction toward the base wall 22, "upward" will refer to the direction away the base wall 22, and "top" will refer to a location spaced away from the base wall 22 in the "upward" direction.

The holder 20 has a third transverse wall 35 having a first transverse edge 36, a second transverse edge 37, and a longitudinal edge 38. The third transverse wall 35 extends inward from the top end 30 of the first side wall 29 of the holder 20. The holder 20 has a fourth transverse wall 40 having a first transverse edge 41, a second transverse edge 42, and a longitudinal edge 43. The fourth transverse wall 40 extends inward from the top end 33 of the second side wall 32 of the holder 20. A fifth wall 44 extends upward from the third end 25 of the base wall 22 at a generally right angle. The fifth wall 44 has a height less than the height of the first side wall 29 and the second side wall 32.

Figure 4:
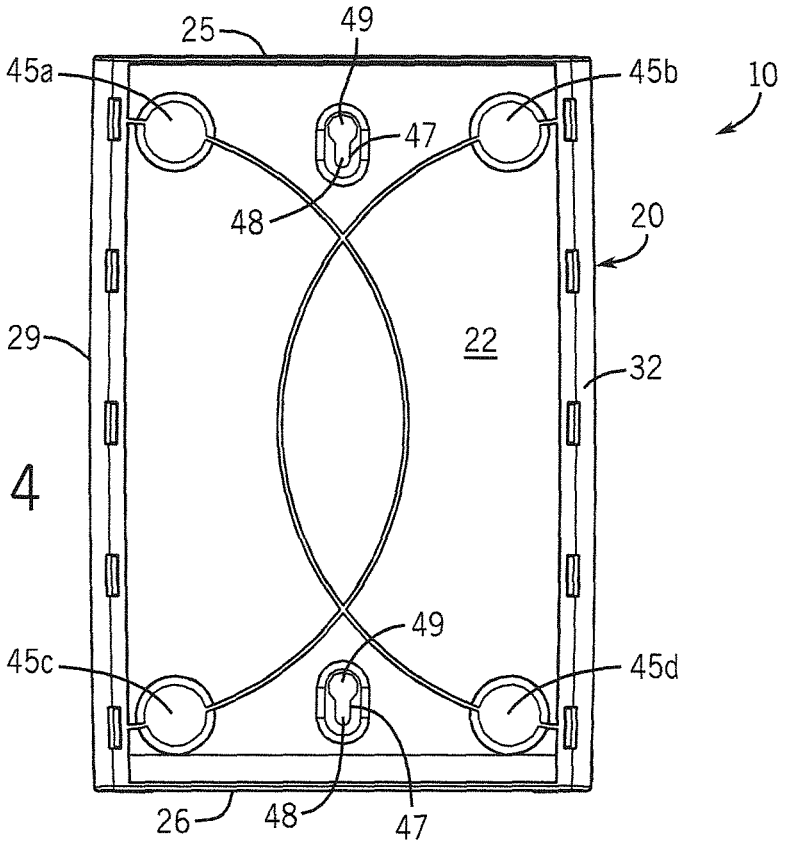
FIG. 4 is a bottom plan view of the dispenser of FIG. 1.
Figure 5:
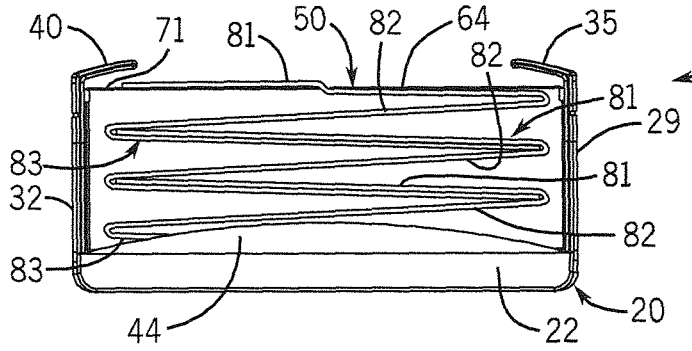
FIG. 5 is a right side elevational view of the dispenser of FIG. 1.
Figure 6:
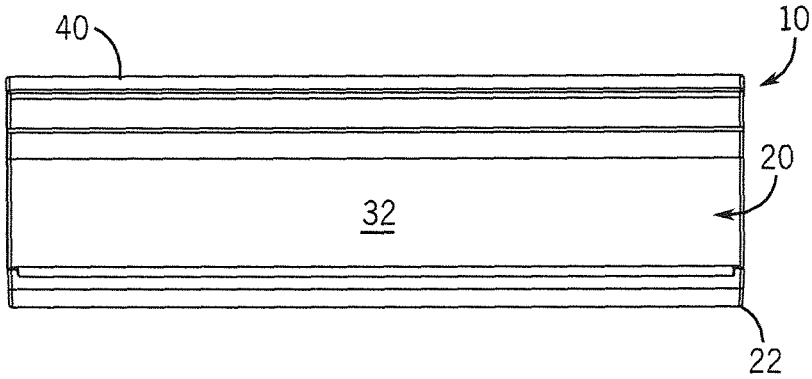
FIG. 6 is front elevational view of the dispenser of FIG. 1.
Figure 7:
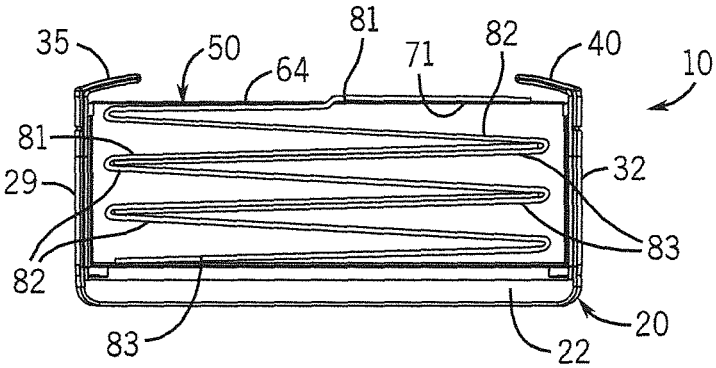
FIG. 7 is a left side elevational view of the dispenser of FIG. 1.
Figure 8:
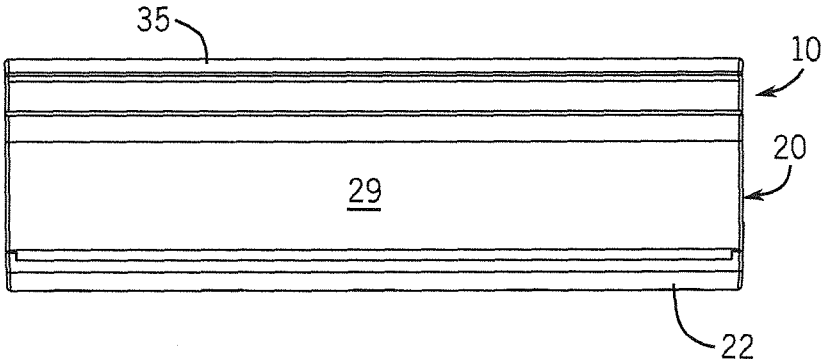
FIG. 8 is a rear elevational view of the dispenser of FIG. 1.

Looking at FIG. 4, the base wall 22 of the holder 20 has support feet 45*a*, 45*b*, 45*c*, 45*d*. When the dispenser 10 is placed on a horizontal surface, such as a kitchen countertop, the support feet 45*a*, 45*b*, 45*c*, 45*d* rest on the horizontal surface. Still referring to FIG. 4, the base wall 22 of the holder 20 also has mounting throughholes 47 having an oblong section 48 connected to an enlarged circular section 49. The dispenser 10 can be mounted on a vertical surface by installing nails or screws with an enlarged head in the vertical surface, aligning the dispenser 10 such that the oblong sections 48 are above the circular sections 49 of the mounting throughholes 47, inserting the enlarged heads of the nails or screws through the circular sections 49 of the mounting throughholes 47, and allowing the shafts of the nails or screws to come to rest in the oblong sections 48 of the mounting throughholes 47. This mounting method also allows for upside down horizontal mounting.

The holder 20 may be fabricated from metallic materials, ceramic materials, or various transparent, translucent, or pigmented polymeric materials, such as polyethylene and polypropylene. In one example embodiment, the holder 20 comprises a pigmented polyolefin such as polyethylene or polypropylene.

The dispenser 10 includes a refill container 50 having a base wall 52 with a first end 53, a second end 54, a third end 55, and a fourth end 56. The refill container 50 has a generally right rectangular prism shape in the embodiment shown. The refill container 50 includes a first side wall 58 having a top end 59, and includes a second side wall 61 having a top end 62. The first side wall 58 extends upward from the first end 53 of the refill container 50, and the second side wall 61 extends upward from the a second end 54 of the refill container 50. The first side wall 58 and the second side wall 61 have a generally rectangular shape in the embodiment shown.

The refill container 50 includes a first flap 64 having a first transverse edge 65, a second transverse edge 66, and a longitudinal edge 67 connecting the first transverse edge 65 and the second transverse edge 66. The first flap 64 extends inward from the top end 59 of the first side wall 58. The refill container 50 includes a second flap 71 having a first transverse edge 72, a second transverse edge 73, and a longitudinal edge 74 connecting the first transverse edge 72 and the second transverse edge 73. The longitudinal edge 67 and the longitudinal edge 74 define a longitudinal dispensing slot 76 of the refill container 50. The dispensing slot 76 of the refill container 50 extends from one end to an opposite end of the refill container 50.

The dispensing slot 76 can open vertically or laterally in relation to the holder 20. For example, the first flap 64 and the second flap 71 may have a gap of up to 1 inch between them, or the first flap 64 and the second flap 71 may overlap by up to 1 inch. When a gap exists between the first flap 64 and the second flap 71, the slot 76 will open vertically. When a overlap exists between the first flap 64 and the second flap 71, the slot 76 will open laterally.

The first flap 64 and the second flap 71 can flex upward when a sheet is dispensed from the refill container 50. The flexibility of the first flap 64 and the second flap 71 is enhanced in that the opposed transverse edges 65, 66 of the first flap 64 and the opposed transverse edges 72, 73 of the second flap 71 are not attached to any side walls of the refill container 50. Optionally, the first side wall 58 and the second side wall 61 of the refill container 50 can also flex outward when a sheet is dispensed from the refill container 50.

The refill container 50 may be fabricated from metallic materials, ceramic materials, or various transparent, translucent, or pigmented polymeric materials, such as polyethylene and polypropylene. In one example embodiment, the refill container 50 comprises a transparent polyolefin such as polyethylene or polypropylene.

In one embodiment, the dispenser 10 of the invention is used for dispensing sheets 80 comprising a sponge material. Sponge materials include a light, fibrous connective, porous structure which has absorbent qualities. Sponge materials can be made from a variety of different materials including polymers, such as polyurethanes, polyethers, polyvinyl alcohol, polyesters, and cellulose. One preferred sponge material is cellulose sponge material because of its excellent water sorption qualities. Typically, cellulose sponge materials are made by dispersing sodium sulfate crystals in a viscose cellulose. The sodium sulfate crystals are melted out of the sponge by heating the viscose cellulose while the viscose cellulose is regenerated to an insoluble state. Once regenerated, the viscose cellulose sponge material is rinsed.

The sheets 80 can have a thickness between 0.030" and 0.250" when dried, and can expand to 0.100" to 0.750" when wet. Alternatively, the sheets 80 can have a dry thickness between 0.040" and 0.070". Alternatively, the sheets 80 can have a dry thickness between 0.080" and 0.150". Alternatively, the sheets 80 can have a dry thickness between 0.040" and 0.070". By "dried" or "dry", it is meant that the sheets are dry to the touch. Typically, the sheets 80 of sponge material are used by consumers for a brief period of time, and then thrown away. The size and shape of the sheets can vary, for example, from a small 3"×5" sheet or even an 8"×8" sheet. In one example form, the sheets are 7"×8" before folding and have a 0.050" dry thickness. Preferably, the ratio of width to thickness of the dry sheets is 50 to 500, more preferably, 50 to 250, and more preferably, 100 to 200. Preferably, the ratio of length to thickness of the dry sheets is 50 to 500, more preferably, 50 to 250, and more preferably, 100 to 200. The sheets 80 can have a pore size of 0.005" to 0.500".

In one version of the invention, the sheets 80 are folded into a V-folded interleaved stack of sheets wherein a portion of a leading panel of the next sheet in the flat stack is placed between a leading panel and a trailing panel of the preceding sheet. The width of the leading panel compared to the width of the trailing panel of a V-folded sheet can be varied. For example, the leading panel of a V-folded sheet can be 10% to 900% of the width of the trailing panel of the V-folded sheet. More preferably, the leading panel of the V-folded sheet can be 10% to 500% of the width of the trailing panel of the V-folded sheet. More preferably, the leading panel of the V-folded sheet can be 20% to 200% of the width of the trailing panel of the V-folded sheet. More preferably, the leading panel of the V-folded sheet can be 50% to 150% of the width of the trailing panel of the V-folded sheet. More preferably, the leading panel of the V-folded sheet can be 90% to 110% of the width of the trailing panel of the V-folded sheet.

In another version of the invention, the sheets 80 are Z-folded and interleaved such that a portion of a leading panel of the next sheet in the flat stack is placed between a center panel and a trailing panel of the preceding sheet. In FIGS. 1, 2, 5 and 7, three sheets 80 are shown Z-folded and interleaved such that a portion of a leading panel 81 of the next sheet in the flat stack is placed between a center panel 82 and a trailing panel 83 of the preceding sheet. It should be appreciated that three sheets 80 are shown in the refill container 50 in FIGS. 1, 2, 5 and 7 for ease of illustration and that the stack of sheets 80 can include many more sheets in the refill container 50. In one example embodiment, a fully loaded refill container 50 includes twenty sheets 80 Z-folded and interleaved. The width of the leading panel compared to the width of the trailing panel of a Z-folded sheet can be varied. For example, the leading panel of a Z-folded sheet can be 10% to 900% of the width of the trailing panel of the Z-folded sheet. More preferably, the leading panel of the Z-folded sheet can be 10% to 500% of the width of the trailing panel of the Z-folded sheet. More preferably, the leading panel of the Z-folded sheet can be 20% to 200% of the width of the trailing panel of the Z-folded sheet. More preferably, the leading panel of the Z-folded sheet can be 50% to 150% of the width of the trailing panel of the Z-folded sheet. More preferably, the leading panel of the Z-folded sheet can be 90% to 110% of the width of the trailing panel of the Z-folded sheet.

In still another version of the invention, the sheets 80 are W-folded and interleaved such that the leading panel and a first center panel of a subsequent sheet are placed between a second center panel and the trailing panel of the preceding sheet. Any of these folding methods for the sheets enables the one handed dispensing of the dispenser 10.

Having described the construction of the dispenser 10, the use of the dispenser 10 can be described with reference to FIGS. 1-8. The refill container 50 may be provided preloaded with a stack of sheets, or alternatively, a user can insert a stack of sheets into one of the open ends 55, 56 of the refill container 50 (i.e., the refill container 50 can be reused). One advantage of using a preloaded refill container 50 is that a new refill container will have optimum flexibility characteristics for the first flap 64 and the second flap 71, whereas a reused container may have some plastic deformation for the first flap 64 and the second flap 71 that changes the dispensing forces of the dispenser 10. Thus, by using a preloaded refill container 50, the dispensing forces can be consistent from refill container 50 to refill container 50.

Figure 2:
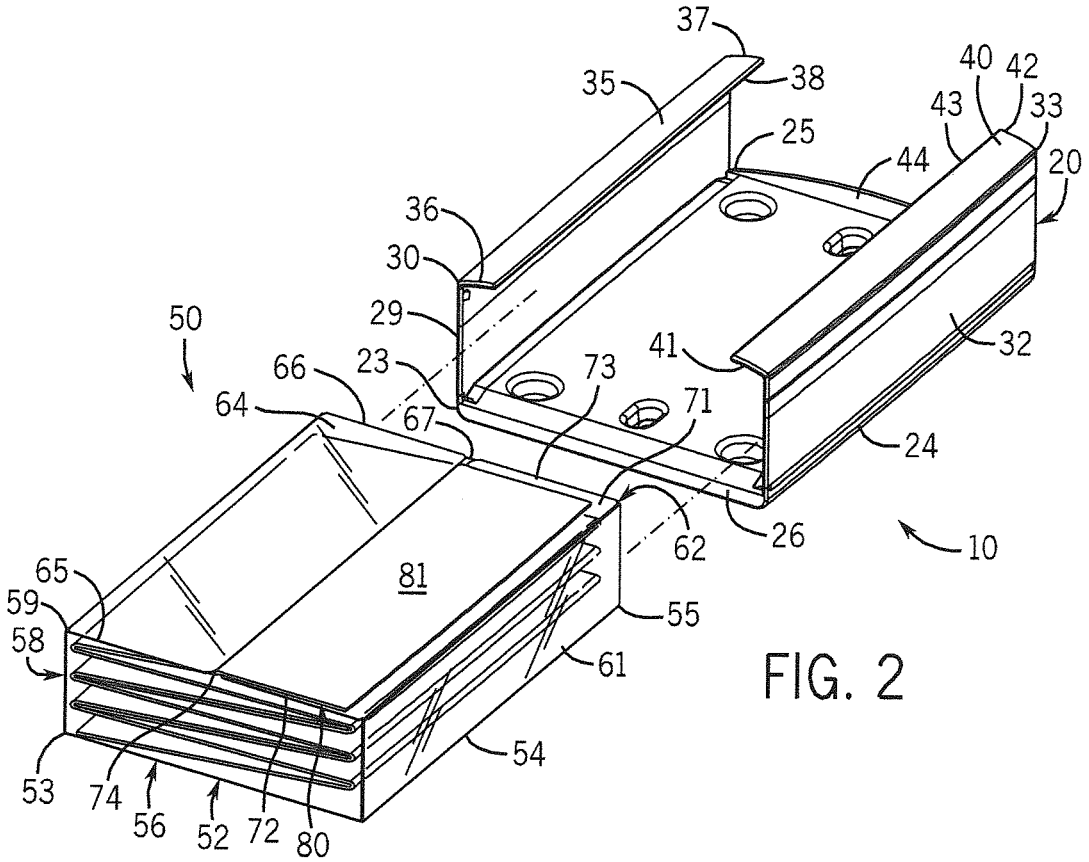
FIG. 2 is a top, left, front perspective view of the dispenser of FIG. 1 showing the installation of a refill container into a holder of the dispenser.
Figure 3:
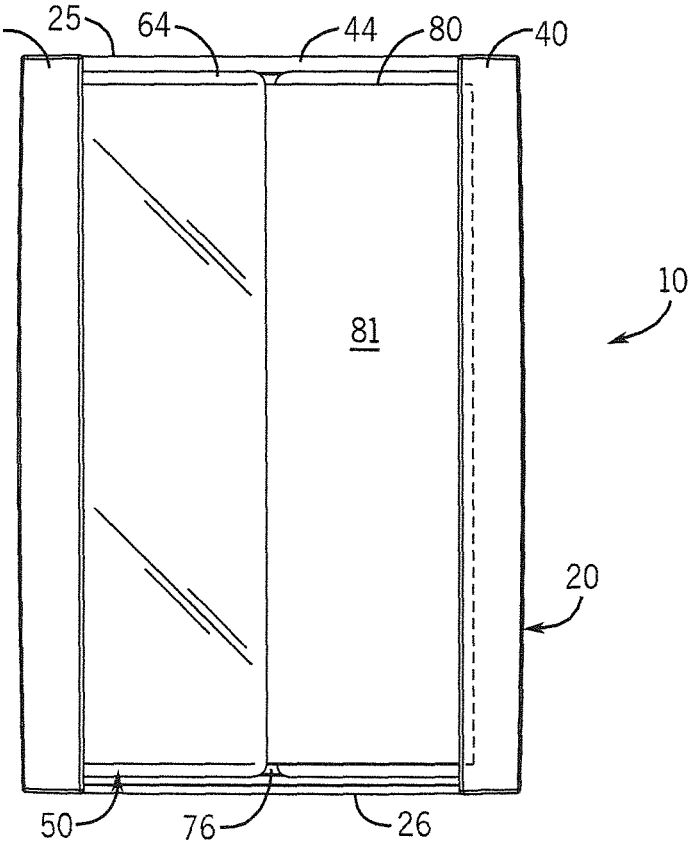
FIG. 3 is a top plan view of the dispenser of FIG. 1.

Referring to FIG. 2, a fully loaded refill container 50 is inserted into the holder 20 until the third end 55 of the base wall 52 of the refill container 50 contacts the fifth wall 44 of the holder 20. The fifth wall 44 of the holder 20 prevents the refill container 50 from exiting the interior space of the holder 20 during installation, and when the holder 20 is mounted vertically, the fifth wall 44 of the holder 20 prevents the refill container 50 from falling down out of the holder 20.

After installing the refill container 50 in the holder 20, the dispenser 10 is ready for use. Looking at FIG. 1, the leading panel 81 of the top sheet 80 in the stack of sheets is shown in a ready position above the second flap 71. The leading panel 81 of the top sheet 80 may be supplied in this position, or can be placed in this position by a user. The user grabs and pulls up on the leading panel 81 of the top sheet 80 in the stack of sheets. The portion of the leading panel 81 under the first flap 64 causes the first flap 64 to flex upward. Because the first flap 64 is elastic, the first flap 64 can remain in contact with the leading panel 81 during dispensing to provide a dispensing resistance preferred by the user. As the user continues to pull up the leading panel 81 of the sheet 80, the sheet will eventually disengage from the following sheet and a portion of the leading panel 81 of the following sheet will be placed in the ready position above the second flap 71 for a subsequent dispensing. The remainder of the following sheet is protected from moisture and dust below the first flap 64 and the second flap 71. The following sheet will be placed in the ready position whether the user pulls up on the top sheet slowly or quickly. In another embodiment, the first flap 64 can be hinged at the top end 59 of the first side wall 58 to provide a dispensing resistance for the sheet 80.

When the refill container 50 includes a V-folded stack of sheets, the leading panel of the top sheet in the stack of sheets will be in a ready position above the second flap 71. The user grabs and pulls up on the leading panel of the top sheet in the stack of sheets. The portion of the leading panel under the first flap 64 causes the first flap 64 to flex upward. Because the first flap 64 is elastic, the first flap 64 can remain in contact with the leading panel during dispensing to provide a dispensing resistance preferred by the user. As the user continues to pull up the leading panel 81 of the sheet 80, the sheet will eventually disengage from the following sheet and the leading panel of the following sheet will be placed in a second ready position above the first flap 64 for a subsequent dispensing.

The first side wall 29 and the second side wall 32 of the holder 20 can transparent in a version of the dispenser 10 wherein a user wishes to view the first side wall 58 and the second side wall 61 of the refill container 50. For example, the outer surface of the first side wall 58 and the second side wall 61 of the refill container 50 can be decorated with customized graphics. A user can then select a refill container 50 having colors that match the interior of the user's home and the transparent first side wall 29 and the second side wall 32 of the holder 20 allow the colors to show through.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides improved absorbent sheets comprising sponge materials and an improved device for dispensing a sponge sheet from a stack of sponge sheets. The sponge sheets are particularly useful for cleaning tasks.

What is claimed is:

1. A device for dispensing a sheet from a stack of sheets, the device comprising:

a holder comprising a holder base wall having a first end and an opposite second end, a first holder side wall extending from the first end of the base wall, a second holder side wall extending from the second end of the holder base wall, a third wall extending inward from an end of the first holder side wall, and a fourth wall extending inward from an end of the second holder side wall wherein the holder base wall, the first holder side wall, the second holder side wall, the third wall and the fourth wall define an inner space of the holder; and a container disposed in the inner space of the holder, the container including a container base wall having a first end and an opposite second end, a first container side wall extending from the first end of the container base wall, a second container side wall extending from the second end of the container base wall, a first flap extending inward from an end of the first container side wall, and a second flap extending inward from an end of the second container side wall, each of the first flap and the second flap having two unattached transverse edges with a longitudinal edge extending there between, the first flap and the second flap being dimensioned to define a longitudinal dispensing slot of the container that extends from one of the two unattached transverse edges to the other, wherein at least one of the first flap and the second flap can flex upward when a sheet is dispensed from the device, wherein the container comprises a transparent material.

2. The device of claim 1 further comprising:

a stack of sheets disposed in the container.

3. The device of claim 2 wherein:

the sheets comprise a sponge material.

4. The device of claim 3 wherein:

the sheets are V-folded and interleaved in a flat stack such that a portion of a leading panel of a following sheet in the flat stack is placed between a leading panel and a trailing panel of a preceding sheet.

5. The device of claim 2 wherein:

the sheets comprise a cellulose sponge material.

6. The device of claim 5 wherein:

the sheets have a thickness between 0.030" and 0.250" when dry.

7. The device of claim 1 wherein:

the holder base wall includes a third end joining the first end to the second end, and the holder further includes a fifth wall extending at a generally right angle from the third end of the holder base wall.

8. The device of claim 1 wherein:

opposed transverse edges of the first flap and the second flap are not attached to any side walls of the container.

9. The device of claim 1 wherein:

the dispensing slot of the container extends from one end to an opposite end of the container.

10. The device of claim 1 wherein:

the holder base wall includes at least one mounting throughhole dimensioned to allow a mounting member to pass into the mounting throughhole for mounting the holder to a surface.

11. A refill container for installation in a holder for a device for dispensing a sheet from a stack of sheets, the refill container comprising:

a base wall having a first end and an opposite second end, a first side wall extending from the first end of the base wall, a second side wall extending from the second end of the base wall, a first flap extending inward from an end of the first side wall, and a second flap extending inward from an end of the second side wall, each of the first flap and the second flap having two unattached transverse edges with a longitudinal edge extending there between, wherein the first flap and the second flap are dimensioned to define a longitudinal dispensing slot of the refill container that extends from one of the two unattached transverse edges to the other, wherein at least one of the first flap and the second flap can flex upward when a sheet is dispensed from the device, wherein the refill container comprises a transparent material.

12. The refill container of claim 11 further comprising:

a stack of sheets disposed in the refill container.

13. The refill container of claim 12 wherein:

the sheets comprise a sponge material.

14. The refill container of claim 13 wherein:

the sheets are V-folded and interleaved in a flat stack such that a portion of a leading panel of a following sheet in the flat stack is placed between a leading panel and a trailing panel of a preceding sheet.

15. The refill container of claim 12 wherein:

the sheets comprise a cellulose sponge material.

16. The refill container of claim 15 wherein:

the sheets have a thickness between 0.030" and 0.250" when dry.

17. The refill container of claim 11 wherein:

opposed transverse edges of the first flap and the second flap are not attached to any side walls of the refill container.

18. The refill container of claim 11 wherein:

the dispensing slot of the refill container extends from one end to an opposite end of the refill container.

* * * * *